United States Patent [19]

Hoshinouchi et al.

[11] Patent Number: 5,071,380

[45] Date of Patent: Dec. 10, 1991

[54] METHOD AND APPARATUS FOR FORMING PATTERNS OF FLUORESCENCE ON A COLOR CRT

[75] Inventors: Susumu Hoshinouchi; Akio Yoshida; Akinobu Kawazu; Tatsunori Hibara; Hiroaki Tobuse, all of Amagasaki, Japan

[73] Assignee: Mitsubishi Denki Kabushiki Kaisha, Tokyo, Japan

[21] Appl. No.: 549,930

[22] Filed: Jul. 9, 1990

[30] Foreign Application Priority Data

Jul. 13, 1989 [JP] Japan ..... 1-180964
May 18, 1990 [JP] Japan ..... 2-129979

[51] Int. Cl.[5] ..... H01J 9/227

[52] U.S. Cl. ..... 445/4; 430/24; 430/30; 430/945; 354/1

[58] Field of Search ..... 445/4, 3, 52; 430/24, 430/30, 945; 354/1

[56] References Cited

U.S. PATENT DOCUMENTS 4,050,081 9/1977 Schulz ..... 430/24
4,053,904 10/1977 Williams ..... 430/24 X
4,053,905 10/1977 Schiafer ..... 430/24 X
4,284,695 8/1981 Fisher ..... 430/24
4,436,394 3/1944 Kelly et al. ..... 430/24 X
4,652,462 3/1987 Nishizawa et al. ..... 430/24 X
4,797,334 1/1989 Glerdinning ..... 430/30 X

FOREIGN PATENT DOCUMENTS 60-9030 1/1985 Japan .

OTHER PUBLICATIONS

"Electron Beam Direct Writing Technology for Printed Wiring Board" (IEEE/CHMT '89 IEMT Symposium).

*Primary Examiner*—Kenneth J. Ramsey

[57] ABSTRACT

A fluorescence pattern forming method and apparatus includes electron beams being irradiated over a face panel, on which a fluorescence layer is formed, to form a fluorescence pattern on a color CRT. The fluorescence layer is formed by coating a slurry of fluorescence substance. According to predetermined pattern designing data, a control device causes the electron beams to be irradiated over the fluorescence layer on the face panel so that the fluorescence luminesces. This luminescence is detected by a light detector located on the convex side of the face panel. A correcting device gives a correcting signal to the control device to correct the irradiated position according to the detected light quantity.

8 Claims, 14 Drawing Sheets

DIFFER-
ENTIATOR
+
-
30
206
204
205
27
SAMPLE-
AND-HOLD
A
28
SAMPLE-
AND-HOLD
B
201
202
203
26
Amp.
200
29
PULSE
GENERATOR

METHOD AND APPARATUS FOR FORMING PATTERNS OF FLUORESCENCE ON A COLOR CRT

BACKGROUND OF THE INVENTION

1. Field of the Invention

This invention relates to a method of and an apparatus for forming a pattern of fluorescence on a color CRT by using electron beams.

2. Description of the Prior Art

Generally, the fluorescent surface of a color CRT is composed of a black light absorbing layer and a fluorescence layer. The fluorescence layer is formed in a pattern of, for example, stripes or dots, with spaces between the stripes or dots of fluorescence being filled with the black light absorbing layer.

FIG. 10 of the accompanying drawings shows a prior exposure apparatus for forming a pattern fluorescence, which is disclosed in Japanese Patent Laid-Open Publication No. 9030/1985.

In the prior exposure apparatus, a face panel 1 is supported on a plate 3 formed on an upper portion of a housing 2 in which a high-voltage mercury-arc lamp serving as a light source 4 for exposure is disposed. A shadow mask 5 is attached to the face panel 1 so that a fluorescence layer can be formed in a predetermined pattern. The shadow mask 5 has a plurality of openings 5*a*, for the passage of light from the light source 4, in a pattern corresponding to the pattern of fluorescence to be formed.

A correcting lens 6 and a filter 7 are disposed between the face panel 1 and the light source 4. The correcting lens 6 serves to deflect the light from the light source 4 in a correct direction, while the filter 7 allows, of the whole light coming from the light source 4, only partial light of a particular wavelength to pass.

The light source 4 is movable, according to the color of the fluorescence to be exposed, to a predetermined position where exposing is to take place.

Consequently, the light from the light source 4 is subjected to a predetermined deflection by the correcting lens 6, and only the partial light having a particular wavelength is allowed to be irradiated over the face panel 1 by the action of the filter 7. However, since the shadow mask 5 is disposed behind the face panel 1, only the light passed through the openings 5*a* of the shadow mask 5 reaches the face panel 1, and as a result, exposing will take place.

The method in which a pattern of fluorescence is formed by using the exposure apparatus of FIG. 10 will now be described with reference to FIGS. 11*a* through 11*i*.

As shown in FIG. 11*a*, firstly, a predetermined pattern of black light absorbing layer 10 is formed on the face panel 1 in a known method. Thus the block light absorbing layer 10 is formed in the form of stripes, for example.

Then, as shown in FIG. 11*b*, a slurry 12*r* is applied over the black light absorbing layer 10 formed on the face panel 1. This slurry 12*r* is a mixture of a liquified photosensitive resin and a red fluorescence. The slurry 12*r* is dried after having been applied over the black light absorbing layer 10.

As shown in FIG. 11*c*, the face panel 1 is then mounted on the plate 3 of the exposure apparatus of FIG. 10, and the shadow mask 5 is attached to the face panel 1, whereupon exposing takes place.

After exposing, the face panel 1 is removed from the exposure apparatus, the inner surface of the face panel 1 is washed, for example, by spraying hot water. Thus, as shown in FIG. 11B, the slurry 12*r* on the non-exposed portion is removed, while only the exposed portion, which is printed by the light passed through the openings 5*a*, remains.

By the foregoing, a red fluorescence pattern has been formed.

To form a green fluorescence pattern, as shown in FIG. 11*e*, a slurry 12*g* including a green fluorescence is applied over the face panel 1 and is then dried, whereupon exposing takes place as shown in FIG. 11*f*.

Then the inner surface of the face panel 1 is washed to remove the slurry 12*g* on the non-exposed portion. As a result, a pattern of the green fluorescence remains as shown in FIG. 11*g*.

Likewise, as shown in FIG. 11*h*, a slurry 12*b* including a blur fluorescence is applied over the face panel 1 and then dried, whereupon exposing takes place as shown in FIG. 11*i*. Then the slurry 12*b* on the non-exposed portion is removed by washing.

By the foregoing, as shown in FIG. 12, the fluorescence patterns of three colors, i.e. red, green and blue, have been formed on the face panel 1. FIG. 13 is a fragmentary plan view showing the pattern including three-color sets of fluorescence strips.

However, the foregoing prior method and apparatus have the following problems.

It is necessary to attach and detach the shadow mask to and from the face panel 1 every time a pattern of each kind of fluorescence is formed, which is laborious and time-consuming, thus causing a reduced rate of production. Further, overlapping over the adjacent fluorescence patterns would be caused by the error in the attaching position of the shadow mask and the light diffraction at the openings of the shadow mask so that an accurate pattern could not occasionally be formed.

With the prior exposure apparatus, a correcting lens is necessary so that dust attached to this correcting lens would be projected, thereby causing a fault pattern. This gives bad influences to the clearness of a color CRT. It is also necessary to change the correcting lens every time the kind of the CRT is changed, which is laborious and time-consuming in adjusting.

SUMMARY OF THE INVENTION

It is therefore an object of this invention to provided a method of and an apparatus for forming a pattern of fluorescence on a color CRT accurately without necessity of using a shadow mask and a correcting lens.

According to a first aspect of the invention, there is provided a method of forming a pattern of fluorescence on a color CRT, comprising the steps of: applying, over a face panel of the color CRT on which a black light absorbing layer is formed in a pattern of light shielding and light transmissive portions, a slurry of mixture of a fluorescence and a photosensitive resin to form a fluorescence layer; preliminarily irradiating, over said fluorescence layer formed on the face panel, weak electron beams which fail to cause said fluorescence layer to be printed due to exposure and which have such a beam intensity so as to cause said fluorescence to luminesce; detecting, of whole light said fluorescence luminesced when said weak electron beams have been irradiated thereover, partial light that has passed through the light transmissive portion of the black light absorbing layer to reach the face panel; correcting, based on a quantity of said detected partial light, a position at which said weak electron beams have been irradiated; and further irradiating strong electron beams onto said corrected position to expose and print said fluorescence layer.

Thus a predetermined pattern of the fluorescence layer formed on the face panel is exposed and printed. This is achieved by removing the slurry of non-exposed portion, with the fluorescence pattern of the irradiated portion remaining. In addition, the foregoing steps are repeated for each of fluorescence layers of two other colors. As a result, the fluorescence patterns of three colors have been formed.

According to a second aspect of the invention, there is provided an apparatus for forming a pattern of fluorescence on a color CRT, comprising: electron beam irradiating means disposed on a concave side of the face panel for irradiating electron beams over the fluorescence layer, said electron beam irradiating means being capable of outputting weak electron beams which fail to cause the fluorescence layer to be printed due to exposure and which have such a beam intensity so as to cause the fluorescence to luminesce and also being capable of outputting strong electron beams which have such a beam intensity so as to expose and print the fluorescence layer; a beam deflecting means for deflecting the electron beams; light detecting means disposed on a convex side of a face panel of the CRT for detecting, of whole light the fluorescence luminesced when the weak electron beams have been irradiated thereover, partial light that has passed through the light transmissive portion of the black light absorbing layer to reach the face panel; control means for controlling said electron beam irradiating means and said beam deflecting means according to predetermined pattern designing data; and correcting means for correcting, based on a quantity of the partial light detected by said light detecting means, a position at which the weak electron beams have been irradiated.

With this arrangement, it is possible to form a pattern of fluorescence, including ascertaining the relationship between the pattern of black light absorbing layer and the irradiated position.

The above and other advantages, features and additional objects of this invention will be manifest to those versed in the art upon making reference to the following detailed description and the accompanying drawings in which a certain preferred embodiments incorporating the principles of this invention are shown by way of illustrative example.

BRIEF DESCRIPTION OF THE DRAWINGS

FIG. I is a diagram schematically showing the entire construction of a fluorescence pattern forming apparatus of this invention.

DETAILED DESCRIPTION

Figure 1:
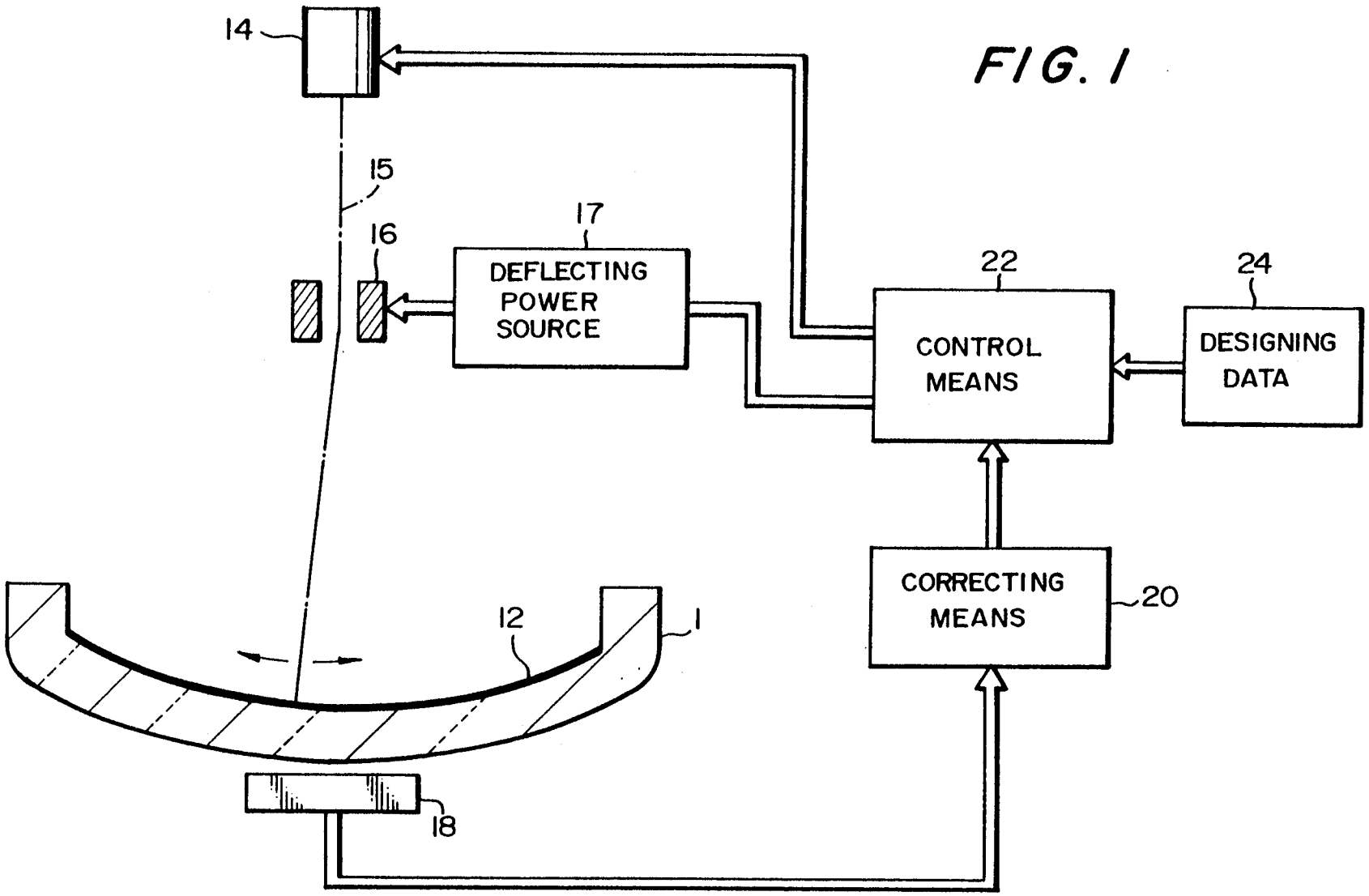

The principles of this invention are particularly useful when embodied in an apparatus for forming a pattern of fluorescence on a color CRT, the entire construction of the apparatus being generally illustrated in FIG. 1.

In FIG. 1, an electron gun 14 for generating electron beams 15 is disposed on a concave side of a face panel 1 on which a fluorescence layer 12 is formed. This electron gun 14 generates weak electron beams and strong electron beams. The weak electron beams are used in correcting the position on which the electron beams 15 are irradiated; the weak electron beams have such a beam intensity that in short-time beam irradiation, the fluorescence layer is not printed due to exposure and that the fluorescence luminesces. The strong electron beams are used in exposing and printing the fluorescence layer and have a beam intensity enough to expose and print the fluorescence layer.

The electron beams 15 outputted from the electron gun 14 are curved in its direction by a deflecting coil 16. Namely, a current is supplied from a deflection power source 17 to the deflecting coil 16, and the beams are deflected and controlled by the supplied current value.

A light detector 18 is disposed on a convex side of the face panel 1. The light detector 18 detects luminescence occurring when the electron beams 15 are irradiated over the fluorescence layer 12 on the face panel 1, in a manner described below in detail. In this embodiment, a photomultiplier tube is used for the light detector 18, and alternatively a photodiode, a television camera, etc. should preferably be used for the light detector 18.

The detection signal detected by the light detector 18 is then transferred to the correcting means 20 where the position on which the electron beams 15 are irradiated is corrected based on the quantity of light detected by the light detector 18. The correction of the irradiated position is performed practically by supplying a correction signal to a control means 22.

The control means 22 controls the deflecting coil 16 via the electron gun 14 and the deflection power source 17. This control is performed according to a pattern designing data 24 that were stored beforehand. Namely, by storing desired fluorescence pattern data in the designing data 24, it is possible to form an optional fluorescence pattern. Upon receipt of a correcting signal from the correcting means 20, the control means 22 corrects the position, which is designated by the pattern designing data 24, to an actual, suitably irradiated position. The control means 22 should preferably be a microcomputer, for example.

The action of the electron beams 15 will now be described in connection with FIGS. 2*a*, 2*b*, 3*a* and 3*b*.

Figure 2A:
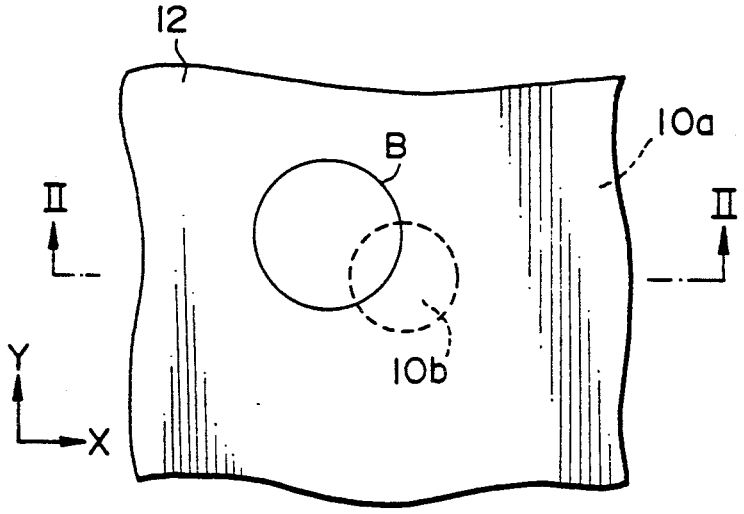
FIG. 2*a* is a fragmentary plan view of a face panel, showing a beam spot on a fluorescence layer on which electron beams are irradiated.

FIG. 2*a* is a plan view of the fluorescence layer 12. In FIG. 2*a*, reference character B designates a spot of the electron beam 15; and a dotted-line circle stands for a light transmissive portion 10*b* of a black light absorbing layer 10.

Figure 2B:
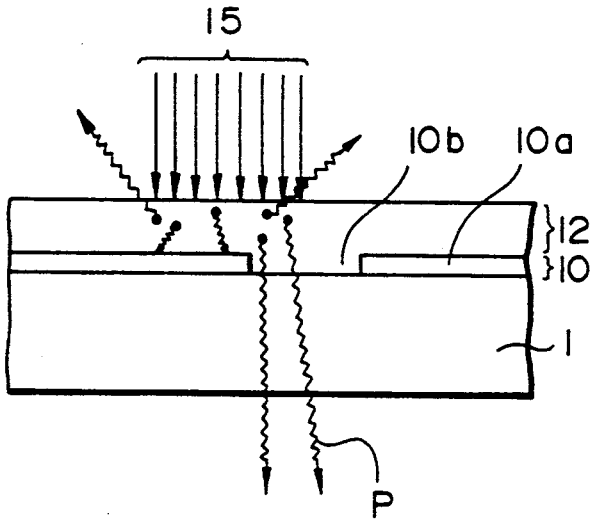
FIG. 2*b* is a cross-sectional view taken along line II—II of FIG. 2*a*, showing the mode of operation of the apparatus of FIG. 1 when electron beams are irradiated over a fluorescence layer formed on a face panel.

Specifically, as shown in FIG. 2*b*, which is a cross-sectional view taken along line II—II of FIG. 2*a*, the black light absorbing layer 10 comprises, in a pattern, a light shielding portion 10*a* formed of a black substance, and the light transmissive portion 10*b* devoid of the black substance. Practically, the light transmissive portion 10*b* is also a portion of the fluorescence layer 12.

When the electron beams are irradiated over the fluorescence layer 12, the fluorescence in the fluorescence layer 12 luminesces, namely, emits light P. A part of the light P passes the light transmissive portion 10*b* to reach the face panel 1 and comes out on the convex side of the face panel 1.

Now assuming that the center of the beam spot B and the center of the light transmissive portion 10*b* are aligned with each other, a maximal quantity of light will be detected by a light detector 18.

Figure 3A:
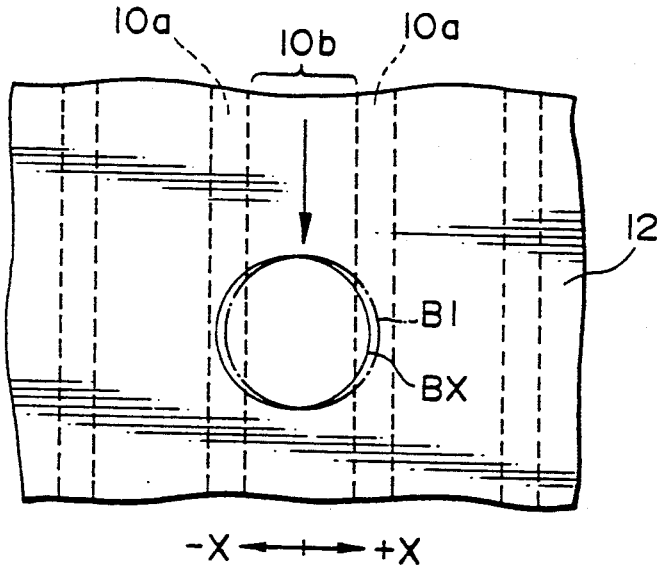
FIG. 3*a* is a fragmentary plan view of the fluorescence layer as irradiated by electron beams.

FIG. 3*a* shows the face panel 12 having the black light absorbing layer 10*a* in the form of stripes; a beam spot BX has deviated from a normal beam spot B1 which is located centrally between the adjacent stripes.

Figure 3B:
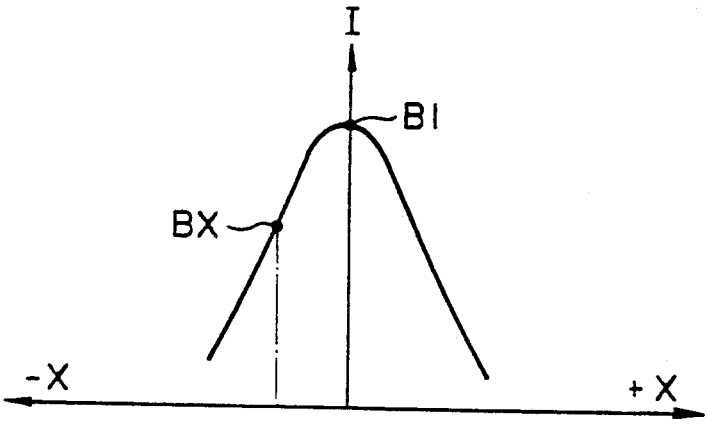
FIG. 3*b* is a graph showing the relationship between the deviation of a beam spot and the quantity of light.

FIG. 3*b* shows the relationship between the deviation of the beam spot and the change of light quantity. If the beam spot BX is deviated from a normal position, as shown in FIG. 3*a*, the quantity of light reduces. If the beam spot BX is located at the normal position B1 as described above, the maximal quantity of light will be obtained.

Therefore, based on the quantity of the transmitted light detected by the light detector 18, it is possible to obtain the position of the beam spot, namely, the position of the light transmissive portion 10*b* of the black light absorbing layer 10.

Based on the change of quantity of light, the correcting means 20 corrects the position (i.e., beam spot) which is irradiated by the electron beams.

Figure 4:
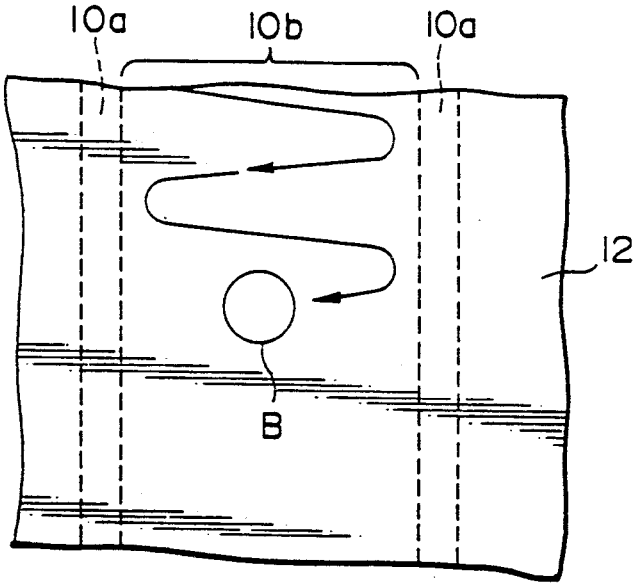
FIG. 4 is a fragmentary plan view of the fluorescence layer, showing the manner of scanning the beam spot.

In the foregoing embodiment, the beam spot B is larger than the light transmissive portion 10*b*. It is possible to correct the irradiated position also when the beam spot B is small, as shown in FIG. 4. In the case of the small beam spot B, it is preferable to scan along a meandering course. Now assuming that the beam spot B reaches the light shielding portion 10*a* of the black light absorbing layer 10 due to some obstacle, it is possible to detect such obstacle from the change of the quantity of light detected by the light detector 18. Therefore the position can be corrected.

A method of forming a pattern of fluorescence will now be described with reference to FIG. 5.

Figure 5:
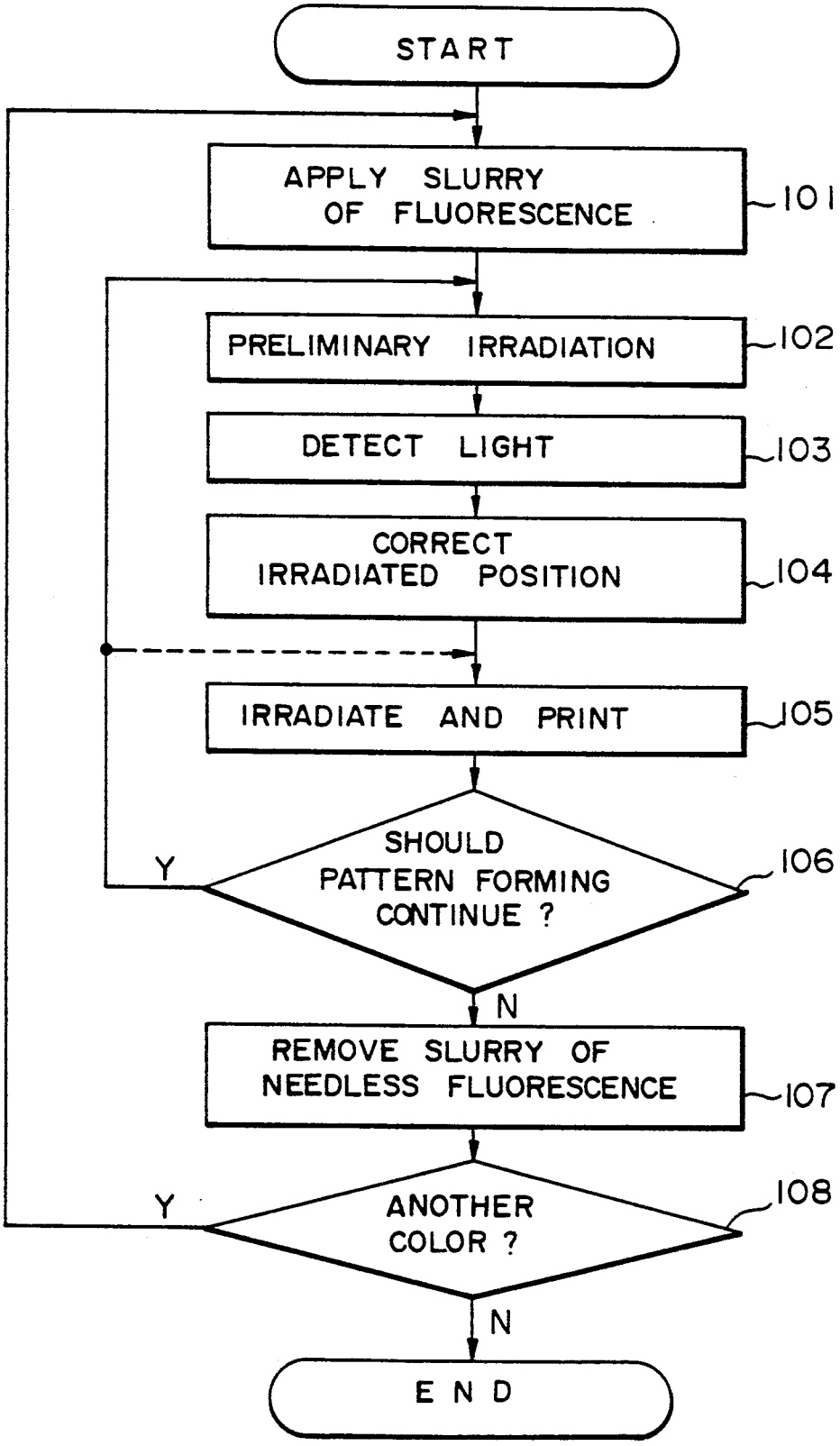
FIG. 5 is a flowchart showing a succession of steps of a fluorescence pattern forming method of this invention.

The successive steps of FIG. 5 can be realized on the apparatus of FIG. 1.

At step 101, a slurry of fluorescence having a predetermined color is coated or applied over the face panel 1 on which a predetermined pattern of black light absorbing layer is formed, and is then dried to form a fluorescence layer 12. The slurry, as mentioned above, is a mixture of a liquefied photosensitive resin and a fluorescence substance.

At step 102, preliminary irradiation is performed. Specifically, the above-mentioned weak electron beams are outputted from the electron gun 14 to be irradiated over the fluorescence layer 12. The irradiation of the electron beams will of course be controlled by the control means 22.

At step 103, light is detected by the light detector 18. Namely, as mentioned above, upon irradiation of the electron beams, the fluorescence luminesces. Of the whole light emitted from the fluorescence, partial light having passed through the light transmissive portion 10*b* of the black light absorbing layer 10 is detected by the light detector 18.

At step 104, the irradiated position is corrected. The direction of deviation from the normal irradiated position can be ascertained by intentionally deviating the beam. In other words, if a quantity of light is obtained, a judgment cannot be made, only from the quantity of light, as to which side of the peak the beam spot is located. Therefore, by moving the beam spot, for example, in +X direction or −X direction, it is possible to ascertain the direction of deviation of the beam from the change of quantity of light.

At step 105, irradiation is made to perform printing. Since the irradiated position has been corrected at step 104, strong electron beams are irradiated on the corrected irradiated position from the electron gun 14 to expose and print that portion.

Then the routine goes to step 106, where if the forming the fluorescence pattern should continue, it goes back to step 102. As indicated by dotted lines in FIG. 5, the routine returns from step 106 (YES) to step 105, where irradiation for printing may be performed continuously. During that time, it is preferable to continuously monitor the irradiated position with respect to the black light absorbing layer 10 by, of course, the light detector 18.

Upon completion of exposure and printing of the fluorescence pattern having a predetermined color, the routine goes to step 107.

At step 107, the face panel 1 is removed from the apparatus of FIG. 1, and the slurry of the nonexposed portion is removed by washing.

Then at step 108, a judgment is made on whether the slurry of fluorescence of the next color is applied; if yes, the routine goes back to step 101. When patterns of three colors have been formed, the operation will be terminated.

According to the method of this invention, as described above, since irradiating can be performed while the irradiated position is being corrected according to the pattern of the black light absorbing layer 10, it is possible to maintain the precise positional relationship between the black light absorbing layer 10 and the fluorescence layer 12, without forming the fluorescence pattern at a position deviated from the normal position.

Therefore, the resulting color CRT is free of, for example, color shifting even after assembling and can provide a clear and sharp image. Further, since this invention does not require, for example, any correcting lens or any filter, it is possible to form a pattern of fluorescence very easily and accurately.

Figure 6:
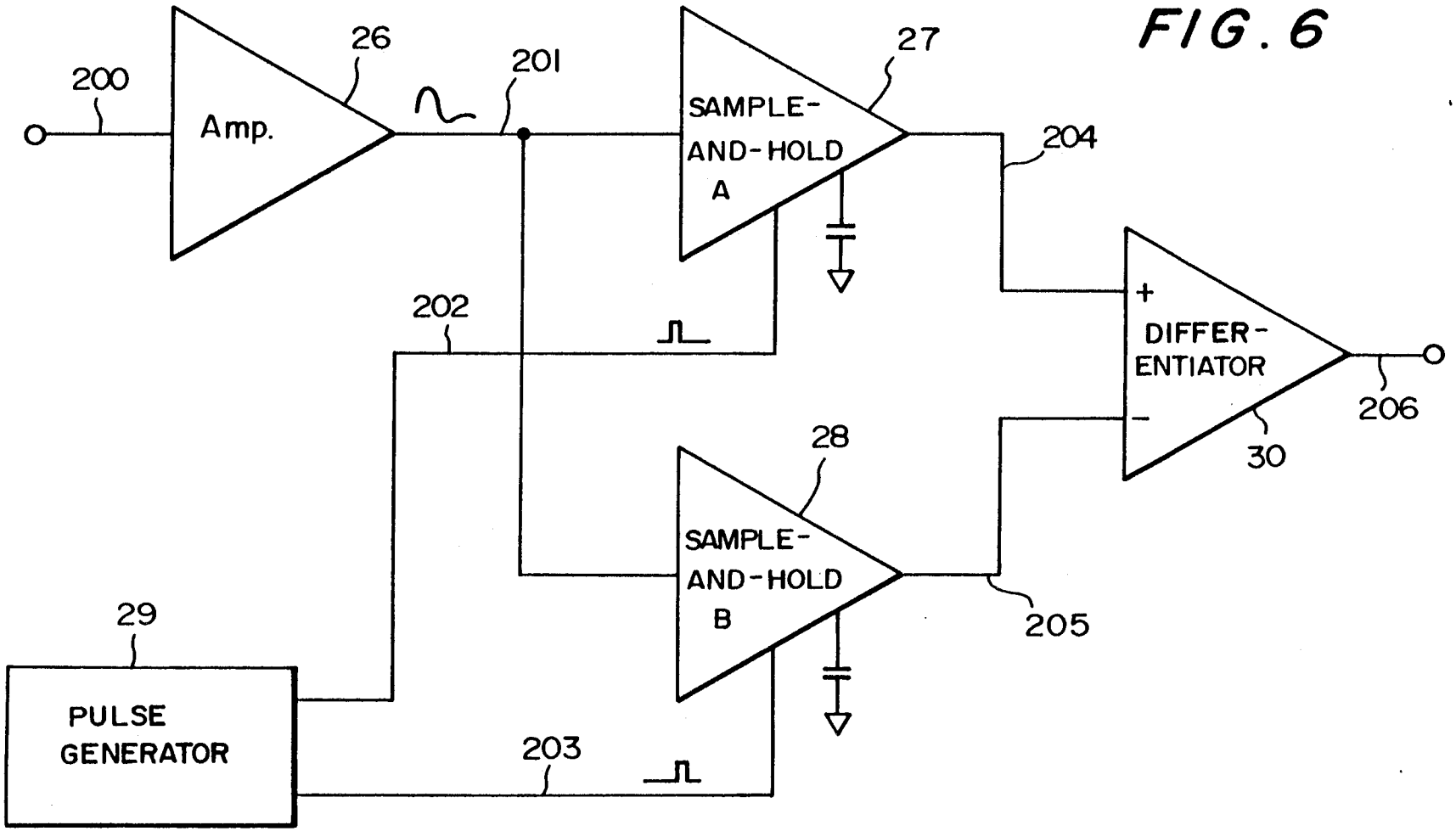
FIG. 6 is a block diagram showing one example of a correcting circuit.

One example of the correcting means 20 will now be described with reference to FIGS. 6 and 7. FIG. 6 is a block diagram showing the detailed structure of the correcting circuit 20, and FIG. 7 is a timing diagram showing various signals in the correcting circuit 20 of FIG. 6.

A signal 200 inputted from the light detector 18 is amplified by an amplifier 26 to provide a signal 201. This signal 201 is then inputted to a sample-and-hold circuit A 27 and a sample-and-hold circuit B 28. To each sample-and-hold circuit, a pulse having a respective predetermined time difference is supplied from a pulse generator circuit 29. Practically, to the sample-and-hold circuit A 27, a pulse 202 is applied, while to the sample-and-hold circuit B 28, a pulse 203 delayed at the interval of a predetermined delay time t behind the pulse 202 is supplied.

Figure 7:
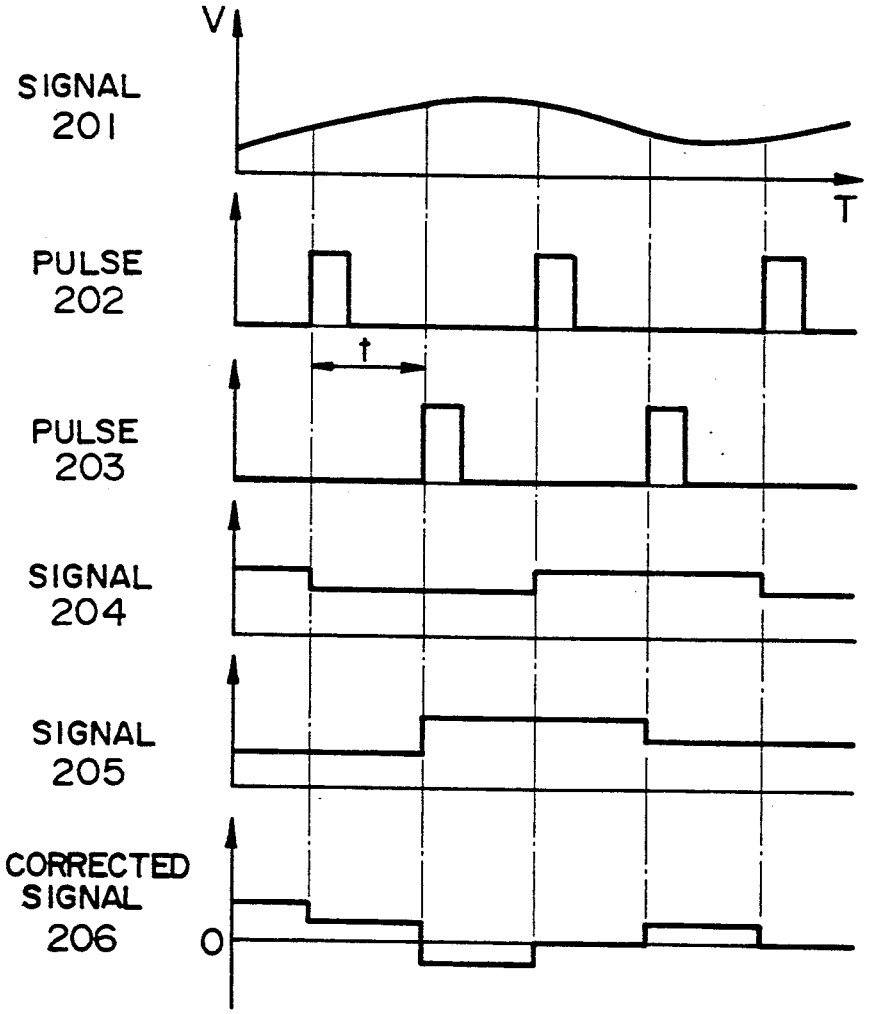
FIG. 7 is a timing diagram of the correcting circuit of FIG. 6.

Therefore, as shown in FIG. 7, the sample-and-hold circuit A 27 latches the signal 201 by the pulse 202, and the sample-and-hold circuit B 28 latches the signal 201 by the pulse 203.

A signal 204 outputted from the sample-and-hold circuit A 27 and a signal 205 outputted from the sample-and-hold circuit B 28 are inputted to a differentiator 30; the difference between the two signals is transferred, as a signal 206, to the control means 22.

According to this circuit, since the change, with the passage of time, of a light detection signal, the control means 22 scans the irradiated position delicately in such a manner that the value of the signal 206 will be zero volts. Therefore, it is possible to determine the irradiated position correctly.

Another example of the light detecting means will now be described with reference to FIG. 8.

Figure 8:
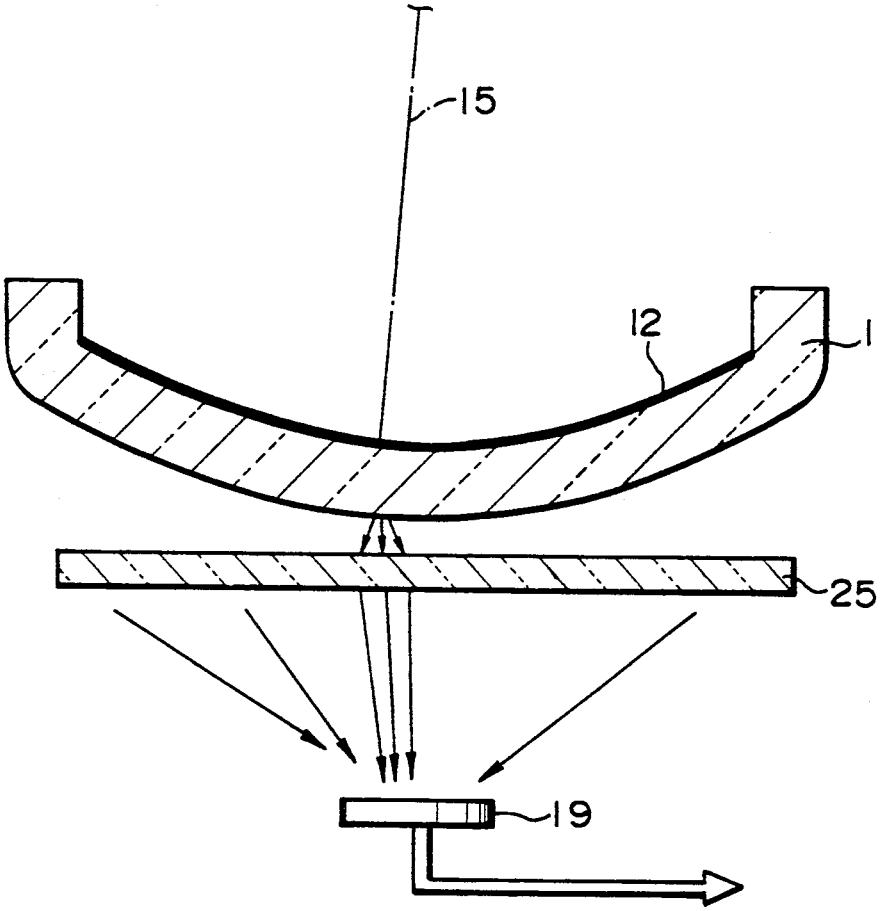
FIG. 8 is a diagram schematically showing one example of a light detecting means.

In FIG. 8, for a significant feature, a light converging lens 25 is disposed between the light detector 19 and the face panel 1.

The light converging lens 25 has a surface as large as the entire surface of the face panel 1, and converges the light, which has passed through the entire surface of the face panel 1, onto the light detector 19 efficiently. The light detector 19 is composed of a plurality of photoelectric transducer elements arranged two-dimensionally; CCDs (charge coupled devices) are used here in this example. A Fresnel lens is used for the light converging lens 25.

With this arrangement, it is unnecessary to move the light detector in timed relation with the scanning of the light detector so that the light detector can be used in a fixed fashion, thus guaranteeing highly precise detection.

Further, by arranging the photoelectric transducer elements two-dimensionally, it is possible to obtain information about the two-dimensional distribution of the light having passed through the light transmissive portion **10*b* of the black light absorbing layer 10**. Therefore, it is possible to perform preliminary irradiation in a short time, without necessity of intentionally scanning the beams in X direction or Y direction to ascertain its position. It is also possible to position the irradiated position with high precision.

Figure 9:
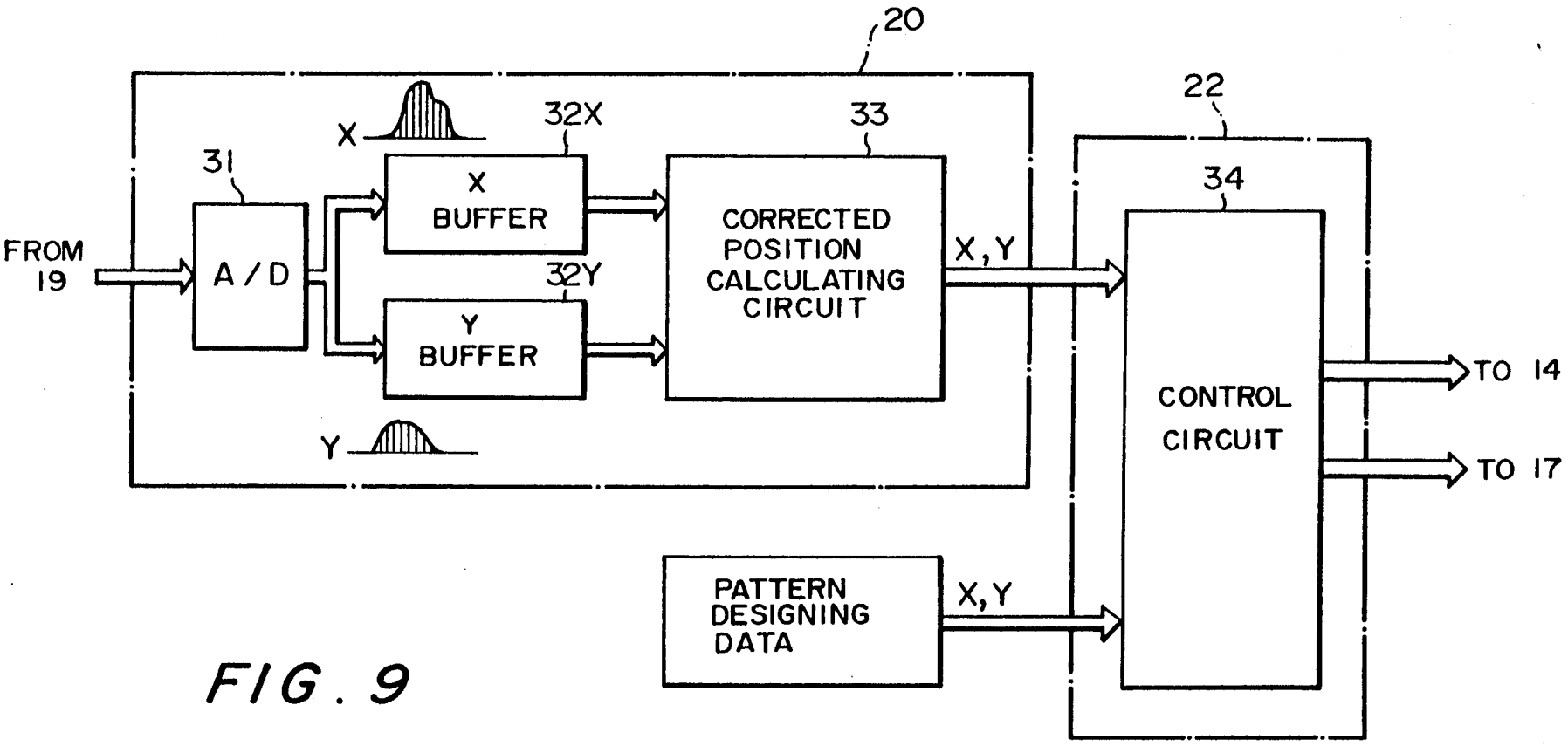
FIG. 9 is a block diagram showing another example of the correcting circuit.
Figure 10:
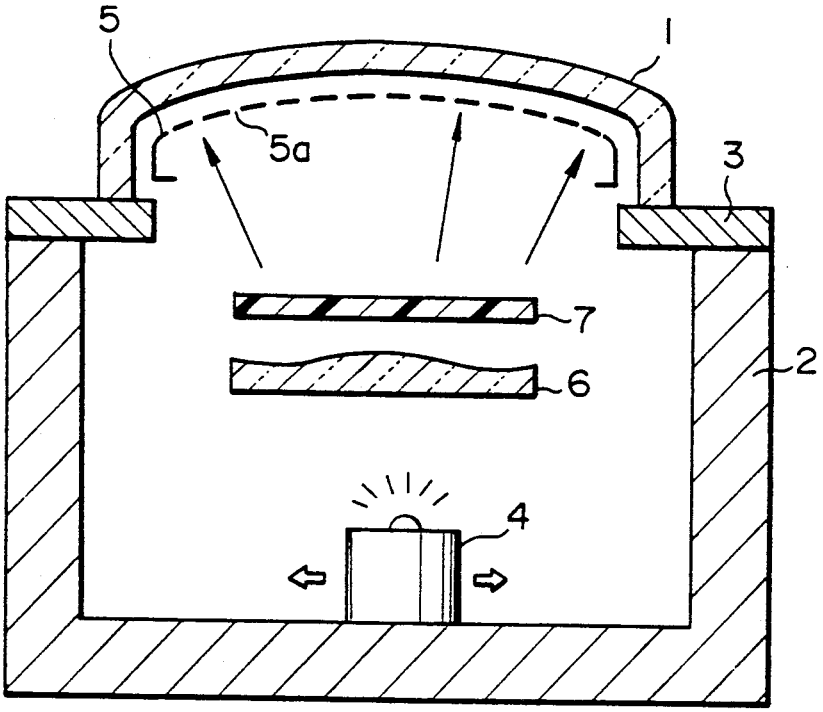
FIG. 10 PRIOR ART
FIG. 10 is a diagram schematically showing a prior art exposure apparatus.
Figure 11A:
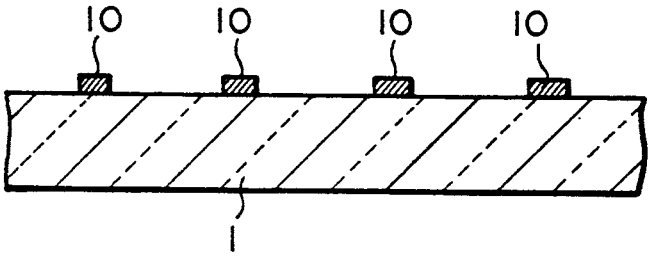
FIG. 11a PRIOR ART
FIGS. 11*a* through 11*i* are fragmentary cross-sectional views of the face panel, showing various successive steps in which a fluorescence pattern is progressively formed according to the prior art.
Figure 11B:
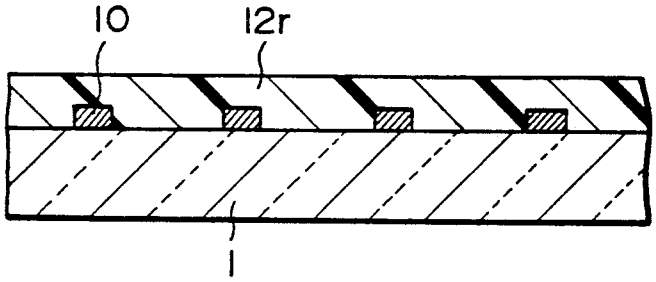
FIG. 11b PRIOR ART
Figure 11C:
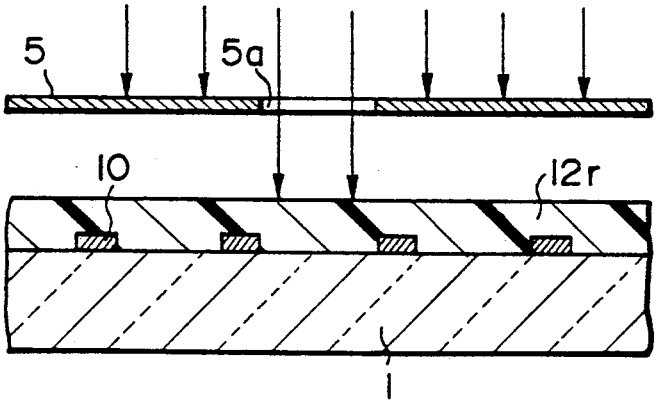
FIG. 11c PRIOR ART
Figure 11D:
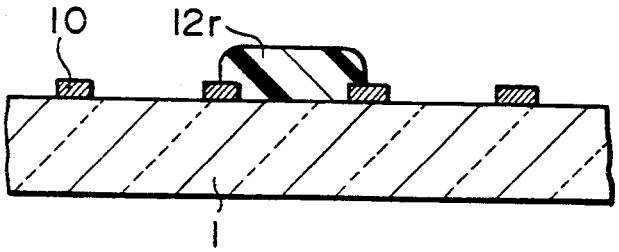
FIG. 11d PRIOR ART
Figure 11E:
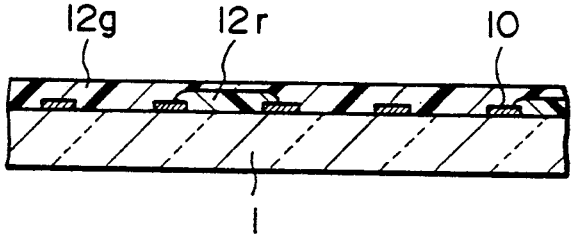
FIG. 11e PRIOR ART
Figure 11F:
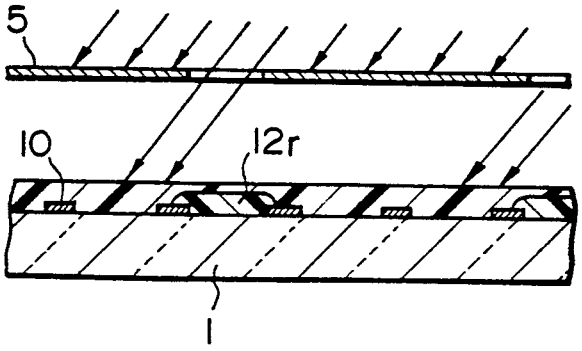
FIG. 11f PRIOR ART
Figure 11G:
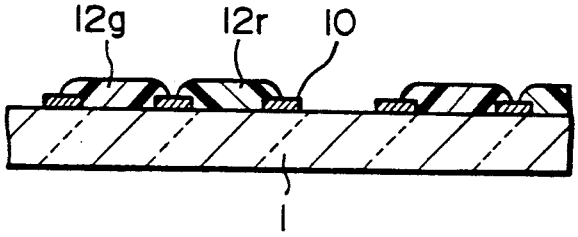
FIG. 11g PRIOR ART
Figure 11H:
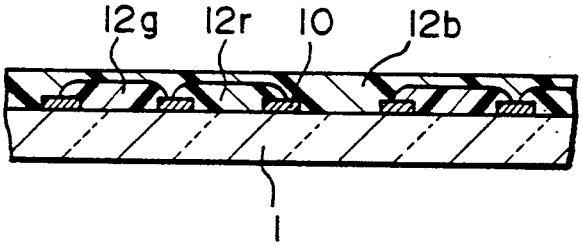
FIG. 11h PRIOR ART
Figure 11I:
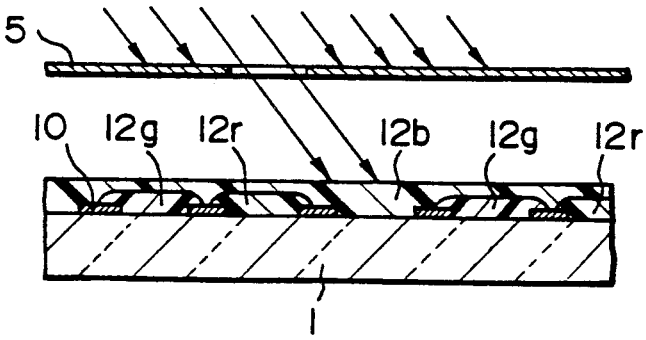
FIG. 11i PRIOR ART
Figure 12:
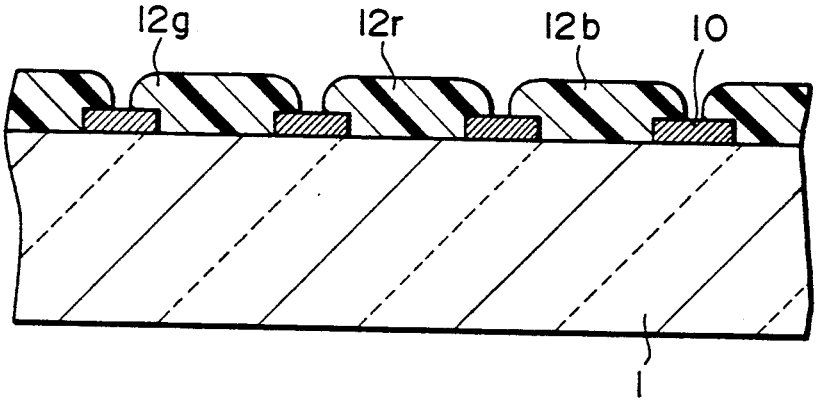
FIG. 12 PRIOR ART
FIG. 12 is a fragmentary cross-sectional view of the face panel on which the fluorescence pattern has been formed according to the prior art.
Figure 13:
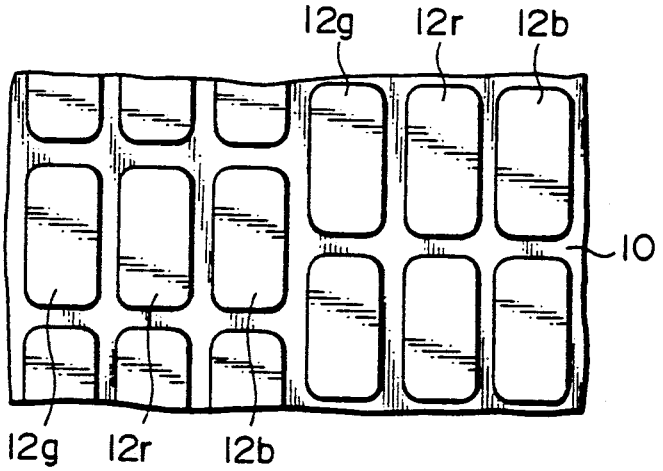
FIG. 13 PRIOR ART
FIG. 13 is a plan view, on a reduced scale, of FIG. 12.

FIG. 9 shows another example of the correcting means 20.

A light detection signal outputted from the detector 19 is A/D converted by an A/D converter 31. Of the converted digital data, X data indicating the light quantity distribution in X direction are stored in an X data buffer **32*x*, and Y data indicating the light quantity distribution in Y direction are stored in a Y data buffer 32*y***.

These stored data are then inputted to a corrected position calculating circuit where a central position (X, Y) in which the maximal quantity of light is obtained can be calculated based on the detected light quantity distribution. The thus calculated data (S, Y) are transferred to the control means 22. In this example, the control means 22 includes a control circuit 34 serving as a microprocessor. This control circuit 34 controls the electron gun 14 and the deflecting coil 16, via the deflection power source 17, based on the data (X, Y) outputted from the correct position calculating circuit 33 and also based on the prestored pattern designing data.

Therefore, partly since the correcting means 20 digitally records the light quantity distribution both in X direction and Y direction and obtains the irradiated position, which is to be corrected, from this distribution information, it is possible to correct the irradiated position very accurately and quickly.

In addition, the operation of the corrected position calculating circuit 33 in the correcting means 20 can be performed by the control circuit 34; this can be easily achieved by changing the programming of the control circuit 34.

What is claimed is:

1. A method of forming a pattern of fluorescence on a color CRT, comprising the steps of:

(a) applying, over a face panel of the color CRT on which a black light absorbing layer is formed in a pattern of light shielding and light transmitting portions, a slurry of mixture of a fluoresence and a photosensitive resin to form a fluorescence layer;

(b) preliminarily irradiating, over said fluorescence layer formed on the face panel, weak electron beams which fail to cause said fluorescence layer to be printed due to exposure and which have such a beam intensity so as to cause said fluorescence to luminesce;

(c) detecting, of whole light said fluorescence luminesced when said weak electron beams have been irradiated thereover, partial light that has passed through the light transmitting portion of the black light absorbing layer to reach the face panel;

(d) correcting, based on a quantity of said detected partial light, a position at which said weak electron beams have been irradiated; and (e) further irradiating strong electron beams onto said corrected position to expose and print said fluorescence layer.

2. A fluorescence pattern forming method according to claim 1, said correcting step including the step of moving said position, at which said weak electron beams have been irradiated, in a predetermined direction, and the step of determining, based on the change of quantity of said detected partial light due to said moving, a direction and situation of said position that is irradiated by the beams from a center of the light transmitting portion.

3. A fluorescence pattern forming method according to claim 2, wherein the position at which the quantity of said detected partial light is maximal is determined as the center of the light transmitting portion.

4. An apparatus for forming a pattern of fluorescence on a fluorescence layer which is a mixture of a fluorescence and a photosensitive resin and which is formed on a predetermined pattern of black light absorbing layer formed on a face panel of a display, said apparatus comprising:

(a) electron beam irradiating means disposed on a concave side of the face panel for irradiating electron beams over the fluorescence layer, said electron beam irradiating means being capable of outputting weak electron beams which fail to cause the fluorescence layer to be printed due to exposure and which have such a beam intensity so as to cause the fluorescence to luminesce and also being capable of outputting strong electron beams which have such a beam intensity so as to expose and print the fluorescence layer;

(b) beam deflecting means for deflecting the electron beams;

(c) light detecting means disposed on a convex side of the face panel for detecting, of whole light the fluorescence luminesced when the weak electron beams have been irradiated thereover, partial light that has passed through a light transmitting portion of the black light absorbing layer to reach the face panel;

(d) control means for controlling said electron beam irradiating means and said beam deflecting means according to predetermined pattern designing data; and (e) correcting means for correcting, based on a quantity of the partial light detected by said light detecting means, a position at which the weak electron beams have been irradiated.

5. A fluorescence pattern forming apparatus according to claim 4, wherein said light detecting means is a light detector which performs optical/electrical conversion.

6. A fluorescence pattern forming apparatus according to claim 5, further including a lens disposed between said light detector and the face panel for converging the light from the face panel onto said light detector.

7. A fluorescence pattern forming apparatus according to claim 6, wherein said correcting means includes:

an X data buffer for storing a quantity distribution of the light transmitted in an X direction on a surface of the face panel;

a Y data buffer for storing a quantity distribution of the light transmitted in a Y direction on the surface of the face panel; and a corrected position calculating circuit for calculating the position from the quantity distribution data stored in said X data and Y data buffers.

8. A fluorescence pattern forming apparatus according to claim 4, wherein said correcting means includes a differentiator for obtaining a change, with the passage of time, of a detection signal from said light detecting means.

* * * * *